US006956339B1

(12) United States Patent
Kureck et al.

(10) Patent No.: US 6,956,339 B1
(45) **Date of Patent: *Oct. 18, 2005**

(54) MULTIPLE HOIST SYNCHRONIZATION APPARATUS AND METHOD

(75) Inventors: Aaron S. Kureck, Nashotah, WI (US); Eric L. Schlevensky, Menomonee Falls, WI (US)

(73) Assignee: Magnetek, Inc., Menomonee Falls, WI (US)

( * ) Notice: Subject to any disclaimer, the term of this patent is extended or adjusted under 35 U.S.C. 154(b) by 99 days.

This patent is subject to a terminal disclaimer.

(21) Appl. No.: 10/458,793

(22) Filed: Jun. 10, 2003

Related U.S. Application Data

(62) Division of application No. 09/871,553, filed on May 31, 2001, now Pat. No. 6,598,859.

(51) Int. Cl.[7] ..... B66D 1/00

(52) U.S. Cl. ..... 318/85; 318/77; 254/292; 254/362

(58) Field of Search ..... 318/41–45, 49, 318/50, 66, 68–74, 77–80, 85; 388/907.5, 388/909; 254/264–266, 290, 292, 362; 414/461, 414/560–564

(56) References Cited

U.S. PATENT DOCUMENTS

| | | | | |
|---|---|---|---|---|
| 1,741,315 A | | 12/1929 | Kendall | |
| 3,718,846 A | * | 2/1973 | Bejach | 318/85 |
| 3,789,280 A | | 1/1974 | Oldfield | |
| 4,093,904 A | * | 6/1978 | Burig et al. | 318/616 |
| 4,266,175 A | | 5/1981 | Braun et al. | |
| 4,405,884 A | * | 9/1983 | Weber | 318/85 |
| 4,423,360 A | * | 12/1983 | Pasterkamp | 318/85 |
| 4,446,587 A | | 5/1984 | Jump | |
| 4,617,498 A | * | 10/1986 | Ruppert | 318/85 |
| 4,665,696 A | | 5/1987 | Rosman | |
| 5,042,965 A | * | 8/1991 | Niessen | 416/34 |
| 5,210,476 A | | 5/1993 | Kazato | |
| 5,324,007 A | | 6/1994 | Freneix | |
| 5,579,931 A | | 12/1996 | Zuehike et al. | |
| 5,625,262 A | | 4/1997 | Lapota | |
| 5,654,620 A | | 8/1997 | Langhorst | |
| 5,874,813 A | | 2/1999 | Bode et al. | |
| 5,893,471 A | | 4/1999 | Zakula | |
| 6,047,581 A | | 4/2000 | Everlove et al. | |
| 6,274,997 B1 | * | 8/2001 | Shiba et al. | 318/700 |

* cited by examiner

*Primary Examiner*—Bentsu Ro
(74) *Attorney, Agent, or Firm*—Waddey & Patterson, P.C.; Larry W. Brantley; Howard H. Bayless

(57) ABSTRACT

A hoist synchronization apparatus and method using a master controller operating software that provides a pulse reference to a slave controller. The slave commands its motor to rotate at the speed conveyed by that pulse reference. The slave controller monitors the pulse feedback from both the master encoder and the slave's encoder and compensates for any position error by adjusting its motor output speed. In addition, the slave controller includes the capability to automatically resynchronize the hoists. Resynchronization is accomplished by storing position error generated when either the master or the slave is run independently and correcting for the error when both units are operated at a later time.

13 Claims, 12 Drawing Sheets

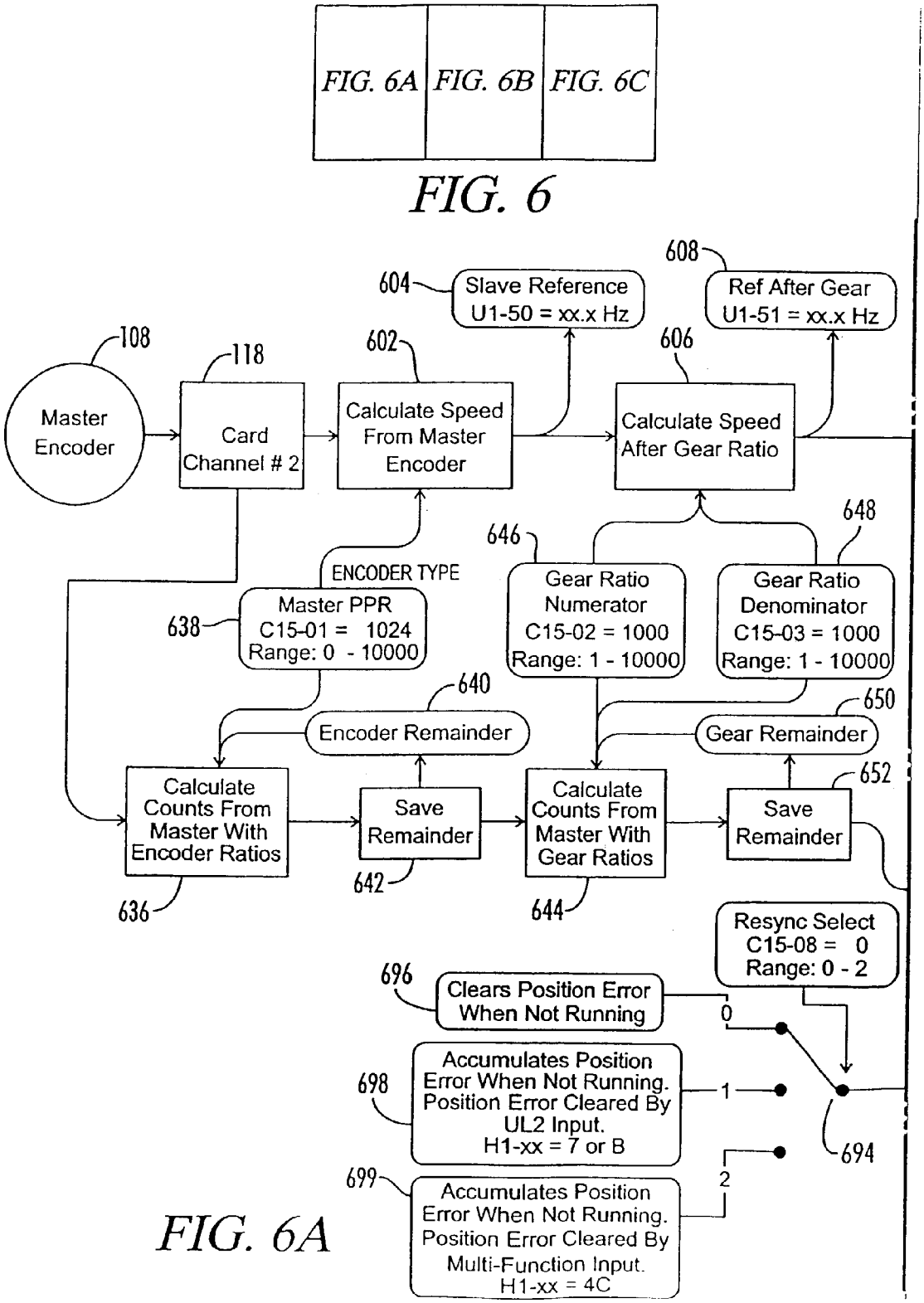
FIG. 6A
FIG. 6B
FIG. 6C
FIG. 6
Master Encoder
108
Card Channel # 2
118
Calculate Speed From Master Encoder
602
Slave Reference U1-50 = xx.x Hz
604
Calculate Speed After Gear Ratio
606
Ref After Gear U1-51 = xx.x Hz
608
ENCODER TYPE
Master PPR C15-01 = 1024 Range: 0 - 10000
638
Gear Ratio Numerator C15-02 = 1000 Range: 1 - 10000
646
Gear Ratio Denominator C15-03 = 1000 Range: 1 - 10000
648
Encoder Remainder
640
Gear Remainder
650
Calculate Counts From Master With Encoder Ratios
636
Save Remainder
642
Calculate Counts From Master With Gear Ratios
644
Save Remainder
652
Resync Select C15-08 = 0 Range: 0 - 2
Clears Position Error When Not Running
696
0
Accumulates Position Error When Not Running. Position Error Cleared By UL2 Input. H1-xx = 7 or B
698
1
694
Accumulates Position Error When Not Running. Position Error Cleared By Multi-Function Input. H1-xx = 4C
699
2
FIG. 6A

FIG. 7

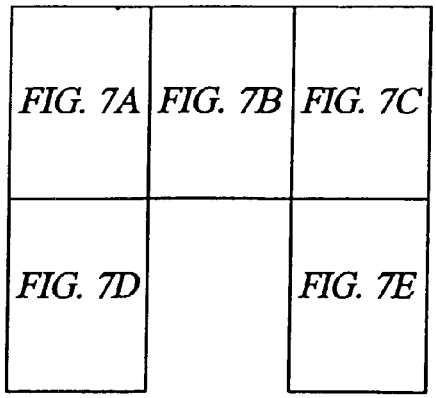

Note: All Faults and Alarms should be annunciated between Master and Slave drive(s). Example: If a Slave has a BE1 alarm, it should be annunciated to all other drives as an External BB MFI.

No Current Detected within C8-02 time. Reset Run Command to Slave(s). Annunciate Alarm

744

IFB OK?

NO

YES

748

- Brake Release Command

BE2

746

754

- No Rollback Detected
- C8-04 Timer Done
- Brake should be Open

Rollback Detected within C8-04 time. Reset Run Command to Slave(s). Annunciate Alarm

750

Rollback Detected? Brake Open Delay Time

YES

NO

752

BE1

FIG. 7A

MULTIPLE HOIST SYNCHRONIZATION APPARATUS AND METHOD

This application is a Divisional application which claims benefit of U.S. patent application Ser. No. 09/871,553 filed May 31, 2001 and entitled "Multiple Hoist Synchronization Apparatus and Method," which issued on Jul. 29, 2003 as U.S. Pat. No. 6,598,859 B1 and is hereby incorporated by reference.

BACKGROUND OF THE INVENTION

The present invention relates generally to the material handling industry and more particularly, this invention pertains to the overhead material handling industry using applications involving dual hoists.

Within the overhead material handling industry, applications involving dual hoists can be inefficient, costly to implement and wrought with safety concerns. Before the use of Programmable Logic Controllers (PLCs), dual trolley loads were raised utilizing two separate motor and drive packages. Since the hoists operated independently, the loads often would rise at incongruent speeds, causing an un-even lift and potentially unsafe working conditions.

Until recently, the only remedy for this situation was to use a PLC in conjunction with the motor and drive packages. Two drives would be applied to two separate motors and encoders, giving hook position feedback to a PLC. The PLC would control the drives in order to synchronize the speeds of each hook. Though it accomplished the mission of synchronizing the hook speeds, it also increased the complexity and cost of the operating system.

Current products and techniques tend to be either open loop or require an extra sensor of some sort. Open loop products give a simultaneous run command and expect the two hoists to follow the same command well enough to perform a synchronized lift. Other devices require a load cell or some other tension/torque measurement device to detect loading of individual cables and adjust speed on drives based on load. One final method is to monitor position from each motor in an external device, such as a PLC, and then adjust the speed command to individual drives based on the position feedback from their respective motor and encoder.

Several United States Patents have been issued for alternative technologies. These include U.S. Pat. No. 4,266,175, issued to Braun et al. on May 5, 1981; U.S. Pat. No. 4,665,696, issued to Rosman on May 19, 1987; U.S. Pat. No. 5,210,473, issued to Backstrand on May 11, 1993; U.S. Pat. No. 5,324,007, issued to Freneix on Jun. 28, 1994; U.S. Pat. No. 5,625,262, issued to Lapota on Apr. 29, 1997; U.S. Pat. No. 5,874,813, issued to Bode et al. on Feb. 23, 1999; and U.S. Pat. No. 6,047,581, issued to Everlove, Jr. et al. on Apr. 11, 2000.

U.S. Pat. No. 4,266,175 issued to Braun, et al. on May 5, 1981 discloses a method for thyristor control of AC wound rotor motors. This patent involves controlling the switching devices which generate the variable frequency output voltage to a motor.

U.S. Pat. No. 4,665,696 issued to Rosman on May 19, 1987 discloses a hydraulically operated hoist for containerized freight or the like. As may be noted in the claims section, this patent refers specifically to a lift system that is hydraulically actuated. Additionally, per Column 10, lines 30–39 and FIG. 5, the ability to help level the load is produced through a level-sensitive transducer. This transducer, in turn, causes the hydraulic pressure to adjust the load to be leveled.

U.S. Pat. No. 5,210,473 issued to Backstrand on May 11, 1993 discloses a system with delay timer for motor load equalization. This patent is directed to a circuit utilizing a control circuit providing a motor speed signal. Two separate motor connected inverters monitor the signal and generate command ramps for the motor speed control. Each inverter includes a microprocessor means which repetitively runs through its program to scan a sequence of program instructions. One of the items read is the motor speed signal which is utilized to control the speed of the motor. The essential purpose of this device is to attempt to provide a more uniform reference to both motor drives. These motor drives are run asynchronously with each motor following the commands of their respective drives. By setting internal parameters related to acceleration, deceleration, or other pertinent speed control parameters, a similar path will be followed. This device attempts to allow each motor and drive to proceed through initial start-up conditions, such as receiving a run command, generating initial torque, and opening the brake, and then wait at some speed for a set dwell time to ensure both motors are ready to run at the commanded reference speed. At this point the motors begin to follow the independent command trajectories generated by their respective drives.

U.S. Pat. No. 5,324,007 issued to Freneix on Jun. 28, 1994 discloses a load-hoisting system having two synchronously rotating drums operating in parallel. This system has a single motor and controller driving two output shafts. This patent is for a system that is mechanically redundant in order to prevent a load from falling due to a single mechanical failure.

U.S. Pat. No. 5,579,931 issued to Zuehlke, et al. on Dec. 3, 1996 disclosing a system for a lift crane with synchronous rope operation. This method is used by a lift crane which uses two separate ropes attached to a single hook in such a manner that tension can be measured between the two ropes. If the tension changes such that it indicates one of the ropes is moving faster than the other, the speed can then be adjusted so that the two ropes lift at the same speed.

U.S. Pat. No. 5,625,262 issued to Lapota on Apr. 29, 1997 discloses a system for equalizing the load of a plurality of motors. This patent details a method of load sharing between two drives utilized in tandem to control a single hoist. This is accomplished by issuing a torque reference command from the first inverter to the second inverter as noted in column 3, lines 3–16. In column 3, lines 17–30 of this patent, it is claimed that a speed indication of the first motor is sent to the second motor to assist in controlling the speed of the second motor. The only connection between the two drives that is necessary and/or discussed is line 150 of FIG. 3 as referenced in column 7, lines 31–34. This is the torque reference generated by the first drive, labeled 96, and sent to the second drive, labeled 94. Column 4, lines 59–64, reference controller operating by a lever to provide input signals to the drives producing a speed command for the drives. This is one of two common methods of generating a speed command to a drive. This allows for an analog command signal with a range of speed commands from the minimum programmed speed up to the maximum programmed speed. The second method typically uses pushbuttons, but could be any type of discrete input, to generate discrete speed input commands corresponding to pre-programmed levels. This is common practice in the crane and hoist industry.

U.S. Pat. No. 5,874,813 issued to Bode et al. on Feb. 23, 1999 discloses a control method, especially for load balancing of a plurality of electromotor drives. As noted in the background of this patent it is known in the art to utilize a control process in which the difference between the armature currents of two successive drives produces a signal which is used to reduce the speed setpoint in the speed control circuit of the more strongly loaded drive to bring about a load balancing. As noted in Column 4 each of the electric motors have a separate speed control circuit which comprises a speed controller and a proportional feedback unit connected in parallel to the controller. As noted in Column 5, beginning at Line 4, the output of the speed controller is feed into an adder so that the setpoint value can be corrected and delivered to the current controller. The primary purpose of this controller is to provide the proper torque or tension throughout a system in which material is pulled through or across multiple points by multiple motors. In this type of application, controlling the tension is typically the most desired feature of a control system. This explains the primary concentration on controlling current, as torque is directly proportional to current. As stated in column 3, lines 26–30, the effect of the speed feedback controller is limited to allow the separate load-balancing controller to dominate performance in this system.

U.S. Pat. No. 6,047,581 issued to Everlove Jr., et al. on Apr. 11, 2000 discloses a drive system for vertical rack spline-forming machine. This patent discloses the use of two or more motors for driving a spline-forming machine. This invention utilizes a PLC to provide output to two circuit motor power control modules which advance the slide. As noted by the description in this patent a home position is utilized to synchronize the position of the two motors. In the machine tool industry, it is common practice to synchronize a mechanical component which requires dual (multiple) drives such as these rails on a slide by using some sort of electronic home position and an external controller then to keep the two (or more) servomotors running synchronously.

Current control methods typically utilize one of the following methods for synchronizing multiple hoists:

Mechanical coupling between the hoist drums combined with load sharing between the motor drives.

An external sensor to detect differences in speed, alignment or loading of hooks and use of the information to align the hooks.

An external controller used to receive a speed reference and an encoder feedback from each motor drive and use this information to provide the appropriate reference to each drive to maintain alignment of the hooks.

What is needed then is a simplified construction and system for a Multiple Hoist Synchronization Apparatus and Method.

SUMMARY OF THE INVENTION

The hoist synchronization software package allows one or more driven motors to be synchronized to a master encoder signal for driving hoist motors. With the present invention's apparatus and method, a Programmable Logic Controller (PLC) is no longer necessary. In its place a master and slave inverter operation is used to control the hoists. The master encoder provides a pulse reference to the slave that results in the slave commanding its motor to rotate at the speed commanded by that pulse reference. The slave drive, implemented as a Variable Frequency Drive (VFD), monitors the pulse feedback from both the master encoder and the slave's own encoder. The slave will then compensate for any position errors by adjusting its motor's output speed, resulting in near perfect alignment between the system master motor and the slave motor. While both drives are running there is no accumulation of position error, so alignment will always be maintained.

Additionally, when utilizing the new hoist software, the slave VFD possesses the ability to automatically resynchronize the hoists. Automatic resynchronization can be used in multiple configurations. This feature is enabled or disabled on via parameter settings that can provide three optional settings of 0—no automatic resynchronization (hold error), 1—automatic synchronization enabled with position error zeroed by upper limit (synchronize), and 2—automatic synchronization enabled with position error zeroed by multi-function input (synchronize with clear error).

With a parameter setting of 0—no automatic resynchronization (hold error), the slave will hold the position error to zero when either drive operates independently. Thus the resynchronization function is disabled. Once the drives are stopped and a command is given to utilize both hoists together, they will maintain their cur-rent position relative to one another.

With the parameter set to 1—automatic synchronization enabled with position error zeroed by upper limit (synchronize), both hoists can be run to the upper limit and any accumulated position error is cleared out. From that point the hoists will maintain their respective positions to one another. If one hoist is run individually and then both hoists are synchronized again, they will be resynchronized to their initial relative positions to one another without having to go to the upper limits to even them out.

With a setting of 2—automatic synchronization enabled with position error zeroed by multi-function input (synchronize with clear error), the accumulated position error can be cleared at any point by using a multi-function input. This allows the hoists to be set to any position, either aligned or offset from each other, and the accumulated position error is cleared. The hoists will then run together at their respective positions while in the hoist synchronization mode. If one hoist is run individually and then both hoists are run again, they will resynchronize to their respective positions without having to again clear the position error with the multi-function input.

The slave VFD also possesses an electronic gearing feature that allows for synchronization of two or more hoist systems that have unequal hook speeds due to mechanical differences. Consequently the slave can operate at a ratio of the master as though the two were mechanically coupled through belts or gearing.

There are several benefits of utilizing the hoist software, these include: the software allows for independent operation of hoists with resynchronizing capability; the software provides automatic resynchronization between two or more hoists; the software accommodates systems having unequal hook speeds; the software compensates for variations in the encoder PPR between two or more hoists; the software enhances safety by improving control; the software reduces complexity and cost by eliminating the need for a PLC; and the software compensates for mechanical differences between two hoist systems.

The objects and advantages of the invention include: a method of performing synchronization of hoists using encoder feedback from the master motor as a command reference to slave drives; a method of performing functions internal to the drive, some relays are required but no external processor is required; providing the ability to synchronize at any relative position and not just in line with each other; the ability to automatically realign hooks to previous relative position at the beginning of the next run command; and the ability to synchronize non-identical systems. (e.g. different motor speeds, different mechanical gear ratios, or different encoder pulses per revolution).

The present synchronization method is an improvement over the current state of the art in the following ways.

No mechanical coupling is used between any parts of the individual hoists.

The position measurement is obtained from the motor encoders which are already present in the system so no additional sensors or measurements are needed.

All programming is performed in the motor drive, so no additional external controller is required.

The apparatus can easily be configured to synchronize either two or multiple hoists.

Any relative alignment between the hoists can be maintained throughout a lift whereas the typical state of the art typically allows only one relative position (usually in direct alignment) to be maintained.

Different relative alignments between the hoists can be maintained on different lifts in the event that the customer must lift objects of varying size and shape.

The system can automatically restore the last relative alignment between hoists if the individual hoists are run independently and then it is desired that they run synchronously.

The hoists do not need to return to a specific reference point to resynchronize the system.

In addition to these improvements over the prior art, the present hoist synchronization system has the following capabilities:

1. Each hoist is held at zero speed, or a fixed position, until both motors have completed the initial start-up conditions and are ready to run.
2. The present invention performs the hoist synchronization within the motor drives. The slave drive(s) will follow the master drive rather than each drive generating its own command trajectory. This is important because testing has indicated that even if all things are supposedly equal (i.e. motors, drives, parameters, mechanical gearing, etc. . . .) and the motors follow independent trajectories from their respective drives, the motors can end up being one or more revolutions out of position from each other at the end of a commanded run. Effectively this is the difference between an open loop control method used in the prior art, and a closed loop control method used in the present hoist synchronization software.
3. Prior art delay timer circuits must be experimentally adjusted to allow the proper delay time for each system on which it is applied. The present synchronization software has the advantage of reading internal drive signals from both the drive it is installed on as well as the appropriate signals from the other drives to generate a timing independent control system. This control system will simply wait for each drive to reach the appropriate "ready" state before continuing operation. As this may vary slightly between individual runs, the synchronization control allows the most efficient starting between multiple drives.
4. Prior art control systems are primarily concerned with controlling the current to achieve desired torque control whereas the present invention is concerned with controlling position between two or more hoists.
5. The system can set a reference point at any position without adjusting an electronic datum point.

These advantages and methods will be explained in the detailed discussion to follow.

DESCRIPTION OF THE PREFERRED EMBODIMENTS

Figure 1:
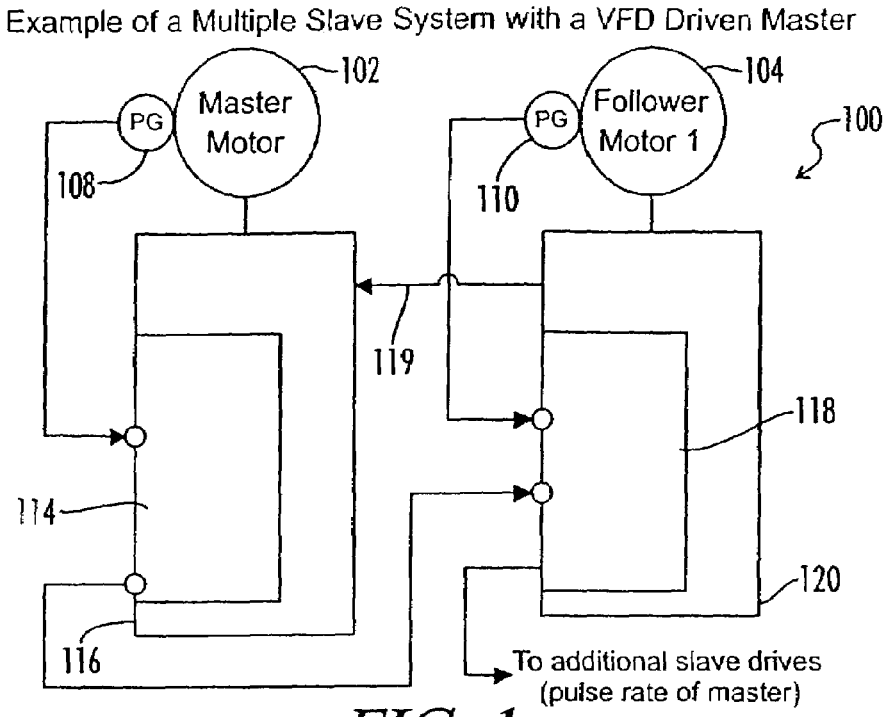
FIG. 1 is a schematic representation of a single slave system with a variable frequency drive controlling the master motor.
Figure 2:
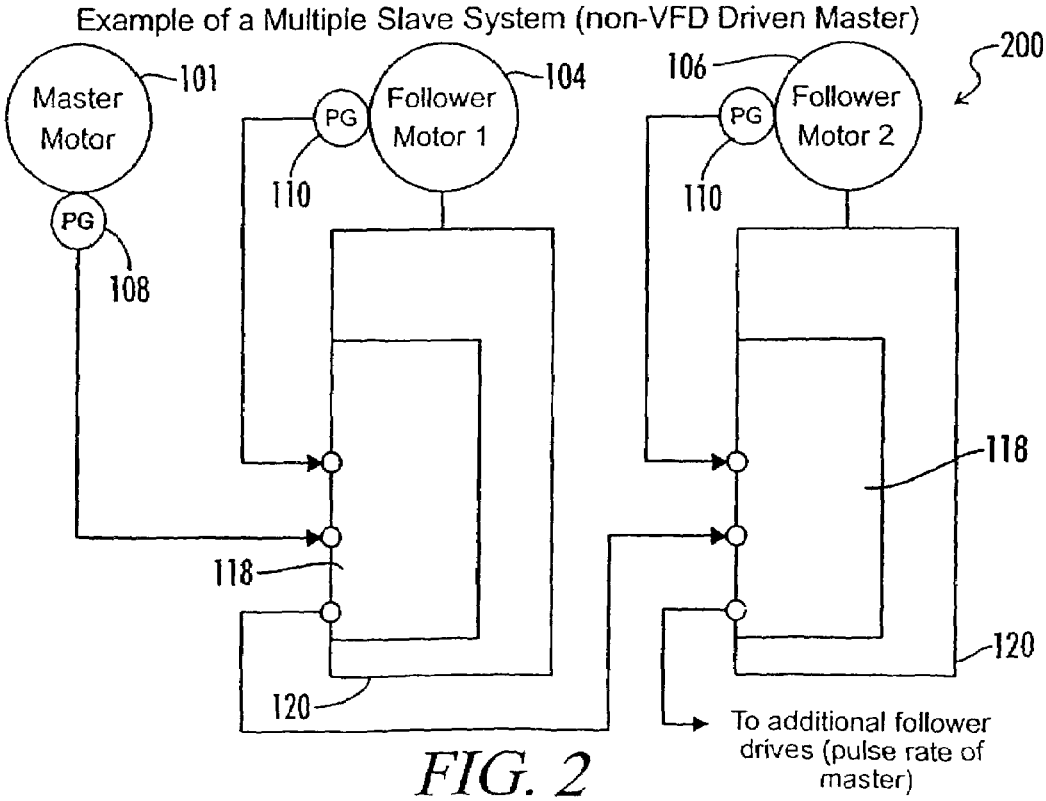
FIG. 2 is a schematic representation of a multiple slave system with an independently controlled master motor.

FIGS. 1 and 2 show schematic representations of multiple slave systems 100, 200. These systems 100, 200 utilize software that allows one or more driven motors 102, 104, 106 to be synchronized to a master encoder signal.

FIG. 1 shows a schematic example of a Multiple Slave System with a Variable Frequency Drive (VFD) Driven Master Motor 102. The VFD driven master motor 102 is electrically controlled by a VFD master drive 116 connected to the motor both directly and through a master encoder 108. The preferred embodiment utilizes an IMPULSE (trademark) VG+Series 2 drive 116 as provided by ELECTROMOTIVE SYSTEMS (trademark) by MAGNETEK, INC (trademark) in combination with option card 114. The master encoder 108, also known as pulse generator 108, provides a master feedback signal about the operation of the VFD driven master motor 102 to the master drive 116. The information provided by the master feedback signal is also forwarded to the slave drive 120. The slave motor 104 is electrically connected to and controlled by the variable frequency slave drive 116 both directly and through a slave encoder 110. The preferred embodiment utilizes an IMPULSE (trademark) Series drive as provided by MAGNETEK, INC. (trademark) in combination with option input card 118. The slave encoder 110, also known as a slave pulse generator 110, provides a slave feedback signal about the operation of the slave motor 104 to the slave drive 120. The slave feedback signal and master feedback signal are then used to control the slave motor 104. The information provided by the master feedback signal may then be forwarded to other slave drives (not shown). In this manner, the master encoder 108 provides a master pulse reference to the slave drive 120 that results in the slave drive 120 commanding the slave motor 104 to rotate at the speed commanded by the master pulse reference. The slave drive 120 monitors the pulse feedback from both the master encoder 108 and the slave's own encoder 110. The slave drive 120 will then compensate for any position errors by adjusting the slave motor's output speed, resulting in near perfect alignment between the master motor 102 and the slave motor 104. While both drives 116, 120 are running, there is no accumulation of position error, so alignment will always be maintained. The slave drive can also send a signal through connection 119 to hold the position of the master motor 102 until the slave drive 120 and associated hoist position has resynchronized to the master drive 116 and its position.

FIG. 2 shows a schematic example of a Multiple Slave System with a Non-Variable Frequency Drive (VFD) Driven Master Motor 101. The non-VFD driven master motor 101 is controlled by any available means well known in the art and is also connected to a master encoder 108. The master encoder 108 provides a master feedback signal about the operation of the non-VFD master motor 101 to the slave drive 120. The Slave Motor 104 is electrically connected to and controlled by the variable frequency slave drive 116 both directly and through a slave encoder 110. The preferred embodiment utilizes an IMPULSE (trademark) Series drive as provided by MAGNETEK, INC. (trademark) in combination with card 118. The slave encoder 110, also known as a slave pulse generator 110, provides a slave feedback signal about the operation of the slave motor 104 to the slave drive 120. The slave feedback signal and master feedback signal are then used to control the slave motor 104. The information provided by the master feedback signal may then be forwarded to another slave drive 120 for powering a second slave motor 106. The information provided by the master feedback signal may then be forwarded to other slave drives in addition to the slave drive 120 shown in FIG. 2. In this manner, the master encoder 108 provides a master pulse reference to the slave drives 120 that result in the slave drives 120 commanding the slave motors 104, 106 to rotate at the speed commanded by the master pulse reference. The slave drives 120 monitor the pulse feedback from both the master encoder 108 and the slave's own encoders 110. The slave drives 120 will then compensate for any position errors by adjusting the slave motor's output speed, resulting in near perfect alignment between the non-VFD master motor 101 and the slave motors 104, 106. While the non-VFD master motor 101 and both drives 116, 120 are running, there is no accumulation of position error, so alignment will always be maintained.

The arrangement shown in FIG. 2 is not shown with the ability to hold the master motor 101 in position for resynchronization. FIG. 2 does not provide a commandable drive to hold the master motor 101 in position while the slave motor 104 is operated to resynchronize. The slave motor 104 can be operated to at least partially can resynchronize by minimizing the position error during operation of slave motor 104 either by itself or during operation of both the master motor 101 and slave motor 106 together. These embodiments are shown for illustrative purposes only and are not meant to limit the various arrangements for implementation of the invention.

Referring to both connection methods shown FIGS. 1 and 2, the slave VFDs 120 are designed with the ability to operate the motors 102, 104, 106 with synchronization and the design of FIG. 1 also includes the ability to automatically resynchronize the hoists through the operation of the motors 102, 104. Synchronization keeps both hoists aligned during operation of both motors, and automatic resynchronization repositions one of the hoists to its respective positions against the other hoist before operation together. When activated, these features are accomplished by storing position error generated when either the master motor 101, 102 or the slave motors 104, 106 are run. For automatic resynchronization, when the hoist motors 101, 102, 104, 106 are again run together, the slave VFDs 120 are first commanded to run in order to cancel the accumulated position error in comparison to the position of the master hoist motor 101, 102. This requires that the controller for the master motor have a control ability to wait for the slave VFD's 120 to be ready to run in the synchronized position. Note: The speed at which the slave VFD 120 is allowed to cancel the accumulated position error may be restricted. In this case, it will be good procedure to have the hoists close to alignment before resynchronization begins in order to avoid a lengthy travel at a low speed.

Once the position error has been resolved, the hoists can be operated with synchronization. For synchronization, the master VFD 116 in FIG. 1 or other appropriate controller for FIG. 2 will begin to run at the commanded speed, and the slave VFD 120 will track the pulse reference generated by the master encoder 108.

Automatic position resynchronization can be used in multiple configurations. This feature is enabled or disabled via the setting of a parameter on the slave drive 120 for three different possibilities: (1) no resynchronization, (2) automatic resynchronization with a home clearing position at the upper limit, and (3) automatic resynchronization with a multifunction input signal for clearing accumulated offset error. The following description uses the nomenclature associated with the VFD driven master drive 116 and the slave drive 120 of FIG. 1 for illustration purposes. For the non-variable frequency driven master of FIG. 2, the master will not wait for the slave to achieve an initial resynchronization before operation. The master will begin operation and the slave will operate to minimize the position error without an initial repositioning.

Figure 3:
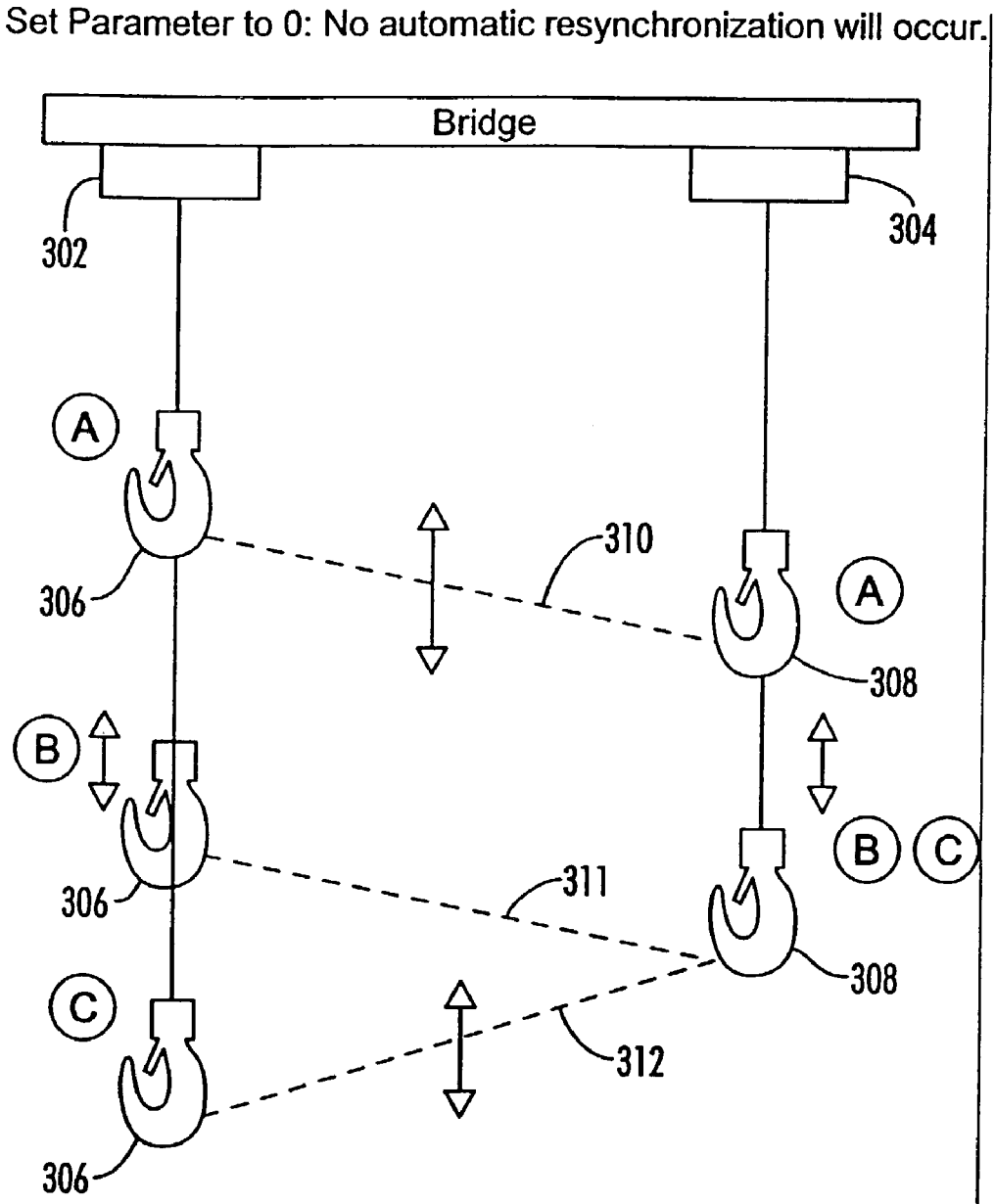
FIG. 3 is a pictorial representation of hoist movement without automatic synchronization.

For the first operation mode for no resynchronization, the input parameter is set to 0. The operation of the drives without resynchronization is shown in FIG. 3 with a master hoist 302 and slave hoist 304. Upon power up, no initial position error will be stored in the slave drive. As shown in FIG. 3, with a parameter setting of 0—no resynchronization for the slave hoist 304, the slave drive 120 will hold the position error to zero when either the master or slave hoist 302, 304 operates independently. Thus, no error is available for the resynchronization function and when the operator selects to run both hoists at the same time, their relative position to one another will be automatically maintained. Therefore, no automatic resynchronization will occur. This is shown in the operation sequence of the hoists 302, 304.

The relative position of the hoists is noted by reference line 310 stretching between the hooks in position A where master hook 306 is located above slave hook 308. Upon power up in this mode, no initial position error will be stored by the slave drive 120. Thus, when the operator selects to run both hoists 302, 304 at the same time, the relative position of hooks 306, 308 to one another will be automatically maintained and reference line 310 will move to a new parallel vertical position. For this illustration, the hooks 306, 308 have been moved downward to position B. A new illustrative connecting line 311 is drawn to show the relationship between the hooks 306, 308. As may be seen in FIG. 3, master hook 306 has been maintained in its relative position above slave hook 308 so that line 311 is parallel to line 310. If the operator then decides to run one of the hoists independently from the other, no position error will be accumulated. To illustrate this in FIG. 3, master hook 306 has been moved independently from slave hook 308 so that the hooks are realigned from position B to position C where the slave hook 308 is located above the master hook 306. The relative locations of the hooks are now represented by line 312. If the operator again selects to run both hoists 302, 304 together after this change of relative positions, the hoists 302, 304 current position relative to one another will be automatically maintained and a new line position will be established parallel to line 312. Thus, slave hook 308 will be maintained in its relative position above master hook 306 during the movement of the hoists 302, 304 and the reference line between the hooks will be moved to a vertically parallel location to line 312 as previously described.

For the second operation mode with the parameter set to 1, both hoists can be run with automatic resynchronization with a home clearing position at the upper limit for automatic accumulated position error clearing. For this setting, the slave drive 120 automatically resynchronizes the slave hoist 304 position to the to master hoist 302 position and the position error is automatically cleared if the hoists are run to the upper limit 402. When the hoists 302, 304 are selected to run independently, their position error accumulates and any position error caused by individual movement of either of the drives 116, 120 is stored in the slave VFD 120. The position error will be cleared by running the slave hoist motor 104 to cancel the error. In addition, the automatic accumulated position error clearing occurs when both hoists 302, 304 are run to the upper limit 402 and the run command is removed. This acts as a "home" position for the hoists 302, 304, at which, the hoists 302, 304 will begin operation with no accumulated error. After the automatic clearing, when both hoists 302, 304 are moved together from the upper limit point 402, the hoists 302, 304 will maintain their respective positions to one another. If one hoist 302, 304 is then run individually and then both hoists 302, 304 are run together again, they will be resynchronized to their initial relative positions to one another without having to go to the upper limits 402 to even them out.

Figure 4:
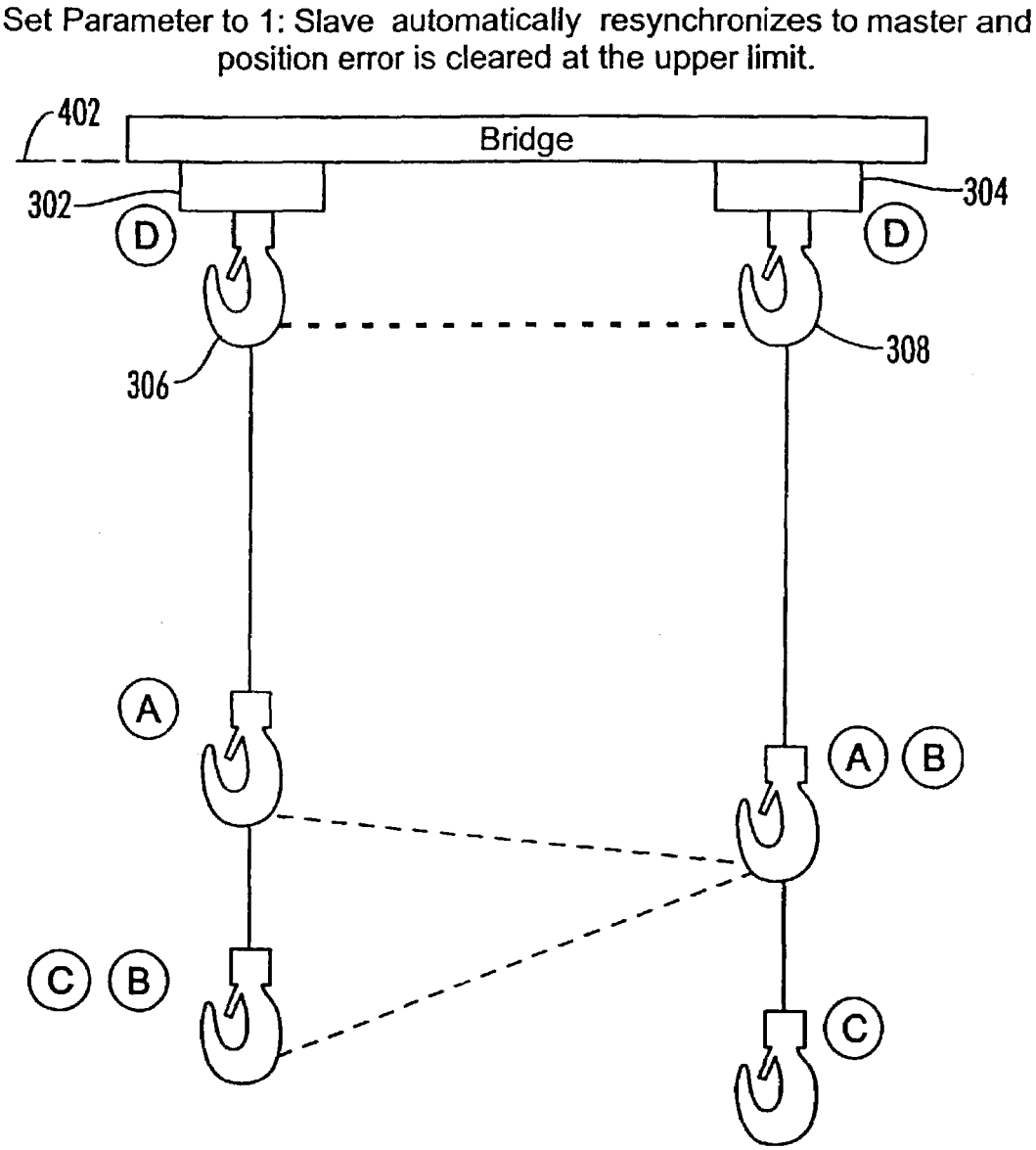
FIG. 4 is a pictorial representation of hoist movement with automatic position synchronization with error clearing at a travel limit.

FIG. 4 shows the operation of the automatic resynchronization and automatic accumulated position error clearing. As shown at position A, upon power up, the initial position error of the hooks 306, 308 is stored. If the operator then selects to run both hoists 302, 304 together, the relative position of the hooks 306, 308 is maintained as previously described for the unsynchronized operation. FIG. 4 then shows the independent operation of the master hoist 302 as the movement of the master hook 306 from position A to position B while the slave hook 308 remains unchanged in position. The slave drive 304 accumulates the position error during the independent movement of the master hook 306. When the operator selects to run both hoists 302, 304, the slave hoist 304 automatically resynchronizes by moving the slave hook 308 from position B to position C such that the slave hook 308 is again in its original relative position in comparison to the master hook. The master hook 306 remains in position until the slave hook 308 reaches the synchronized position. After the slave hook 308 has reached the synchronized position, both hoists 302, 304 will then run together in that relative orientation.

The automatic error clearing occurs when the operator selects to run each hoist 302, 304 independently to its respective upper limit and then removes the run command. After clearing, if the operator then runs both hoists 302, 304 together, they will stay aligned since the position error was cleared at the upper limit.

Figure 5:
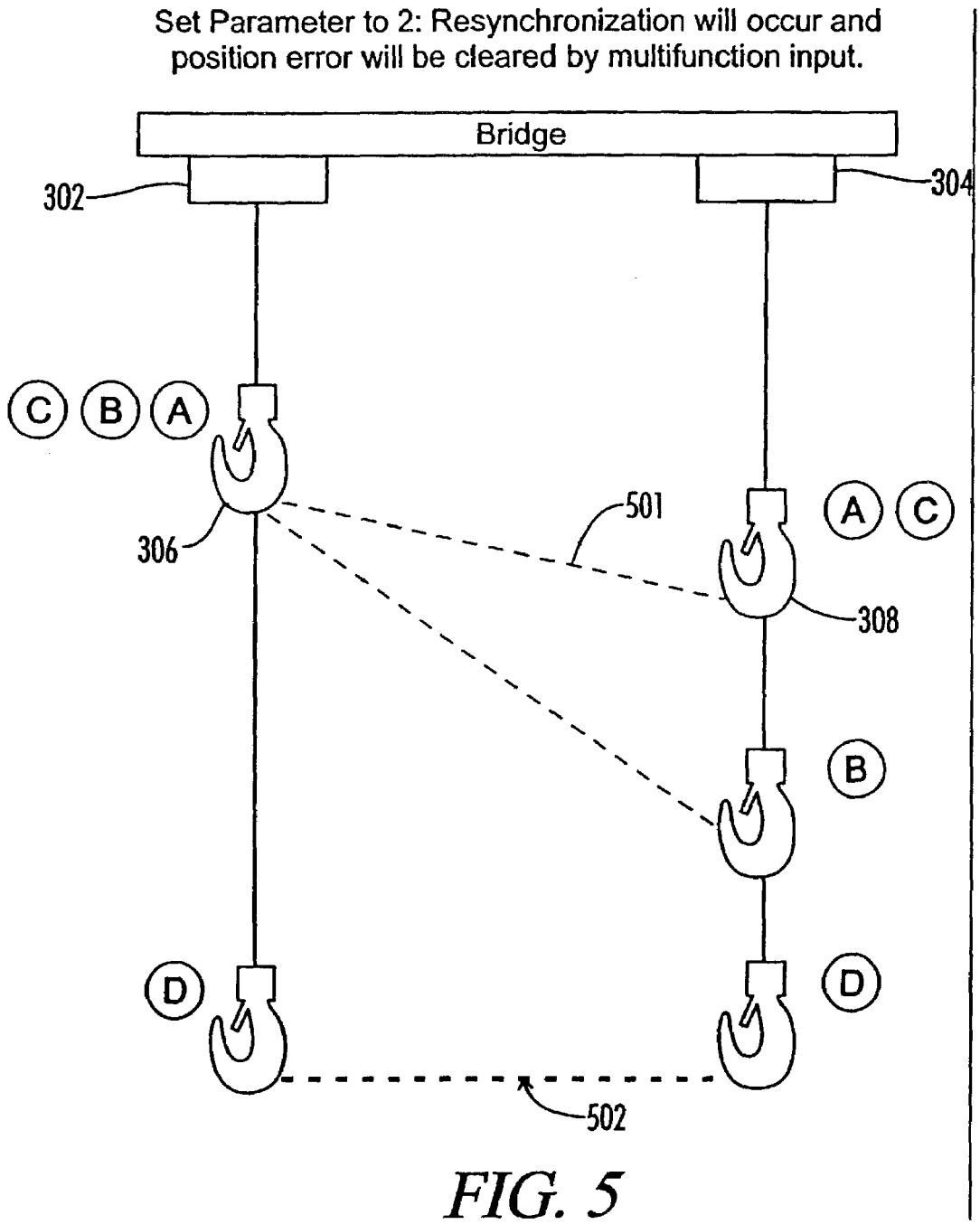
FIG. 5 is a pictorial representation of hoist movement with automatic position synchronization with error clearing through an input signal.

The operation of the third option is shown in FIG. 5. The third option is selected with a parameter setting of 2, where the automatic resynchronization is enabled and the accumulated position error can be cleared at any point by using a multi-function input. Upon power up, no initial position error will be stored. This initial position is shown as position A for the master hook 306 and slave hook 308 as indicated by line 501. When the operator then selects to run both hoists 302, 304 together, their relative position to one another will be automatically maintained as has been previously described. When the operator selects to run either of the hoists 302, 304 independently, position error between the master and the slave is then accumulated. This is shown as the movement of the slave hook 308 to position B while maintaining the master hook 306 in the same position. When both hoists 302, 304 are run again, the slave hoist 304 will resynchronize the slave hook 308 to the relative position of the master hook 306 as shown at position C. Once the hoists are resynchronized, both hoists 302, 304 will run at their original position relative to one another as previously described.

In contrast to the previous embodiment, when the operator selects to run both hoists 302, 304 independently, the multifunction input clears any position error that may occur between the two hoists. Thus, there is a difference between running one hoist independently and multiple hoists independently. This movement is shown as the independent relocation of the hooks 306, 308 to position D. After this multiple independent movement and clearing of the error for the hoists 302, 304, when the operator then selects to run both hoists 302, 304 together, a new relative position between the two hooks 306, 308 is established as indicated by line 502 and this relative position will be the relationship that is automatically maintained. This allows the hoists 302, 304 to be set to any position, aligned or offset from each other, and the accumulated position error may then be cleared. The hoists 302, 304 will then run together at their respective positions while in the hoist synchronization mode.

A further option for the programming of the hoist controls is to program either the master 116 or the slave drives 120 to operate with an electronic gearing feature. The preferred implementation utilizing the IMPULSE (trademark) VG+Series 2 drives allows for synchronization of two hoist systems that have unequal hook speeds due to mechanical differences. This allows the slave motor 104 to operate at a ratio of the master motor 101, 102 as though the two were mechanically coupled through belts or gearing without requiring the external coupling that is prone to mechanical problems.

The software implementation of these described operations will be described in the following discussion.

Figure 6B:
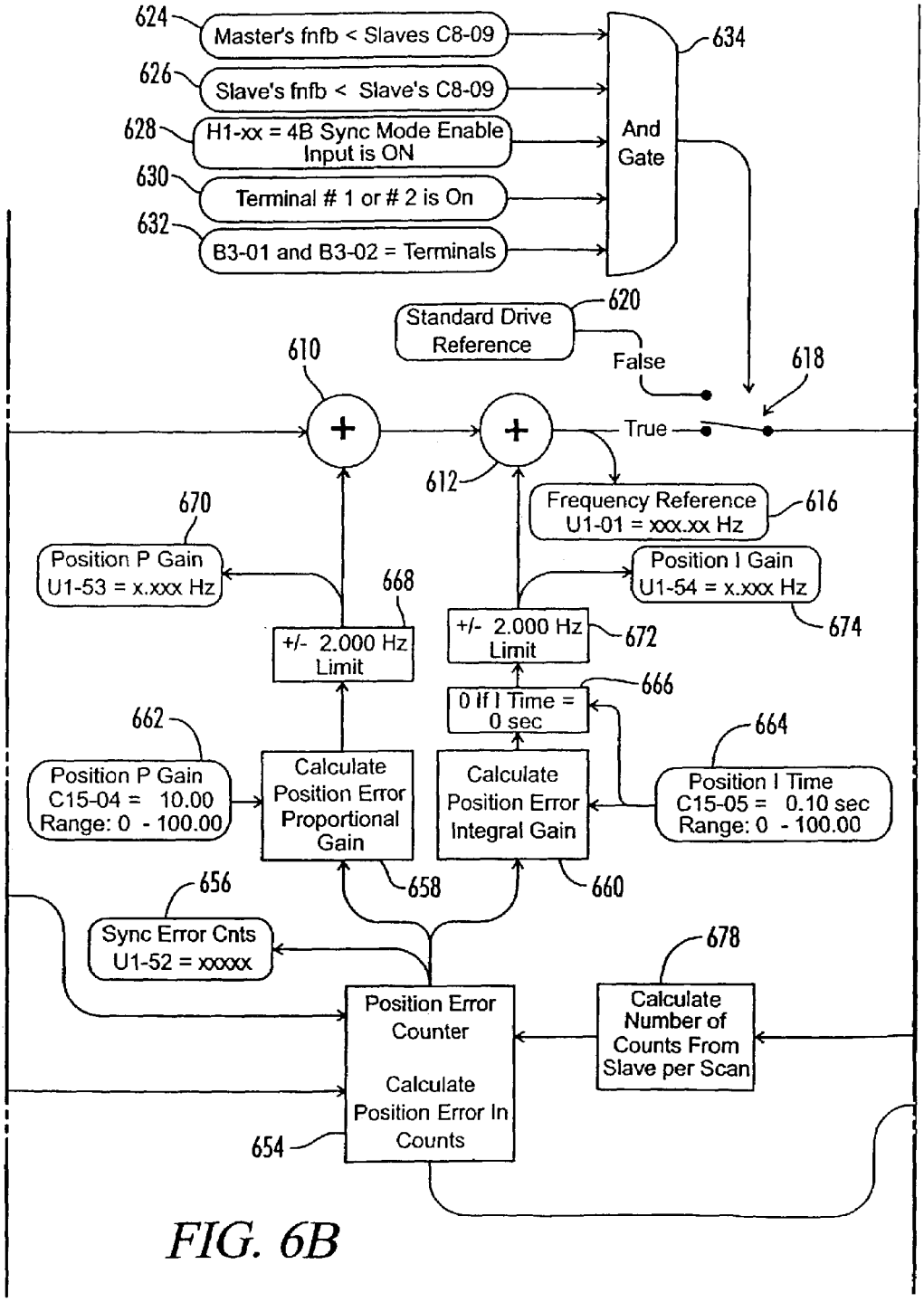
FIG. 6 is a schematic representation of an inverter control sequence for adjusting the inverter output, collectively represented by FIGS. 6A through 6C.
Figure 6C:
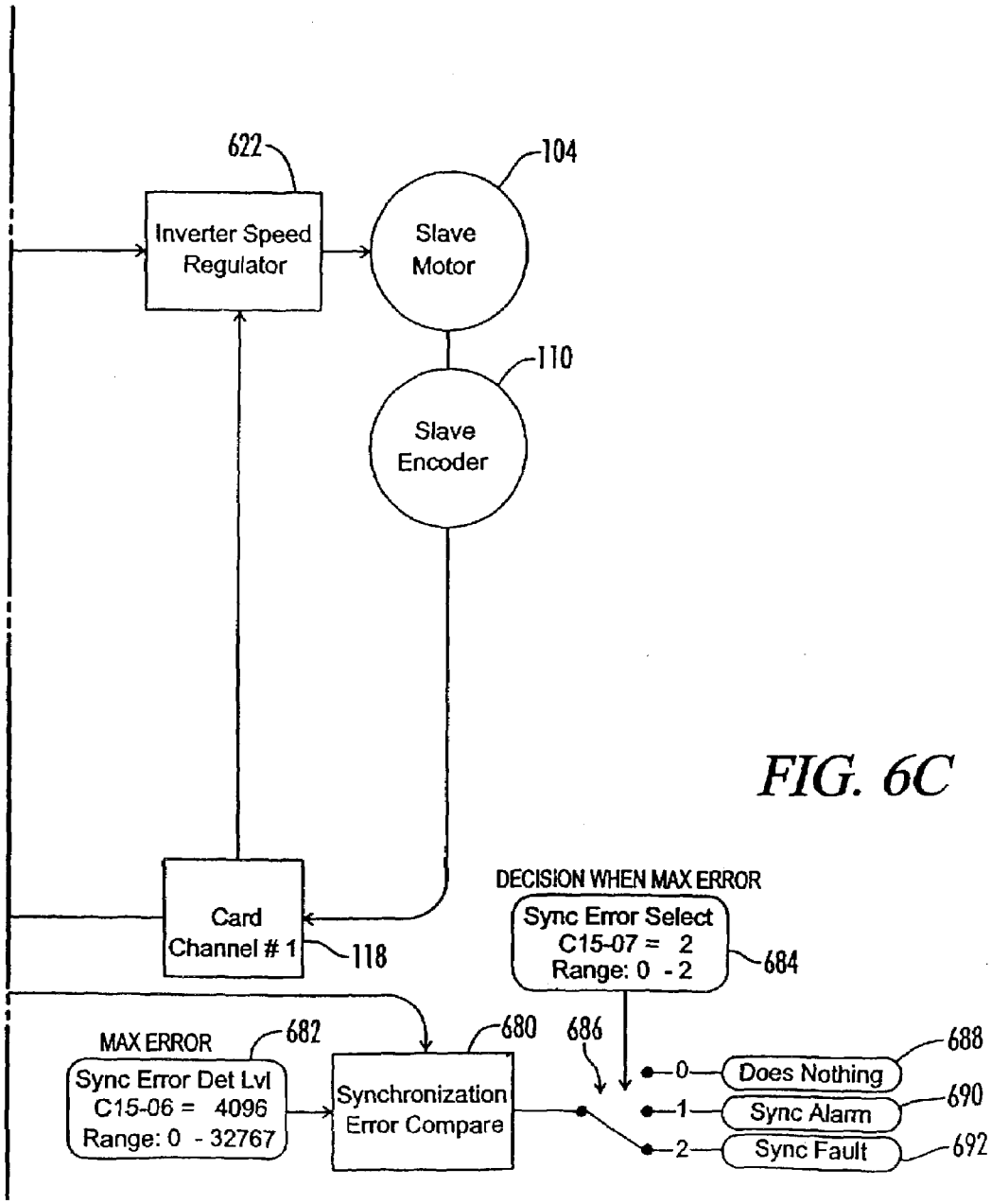
Figure 7B:
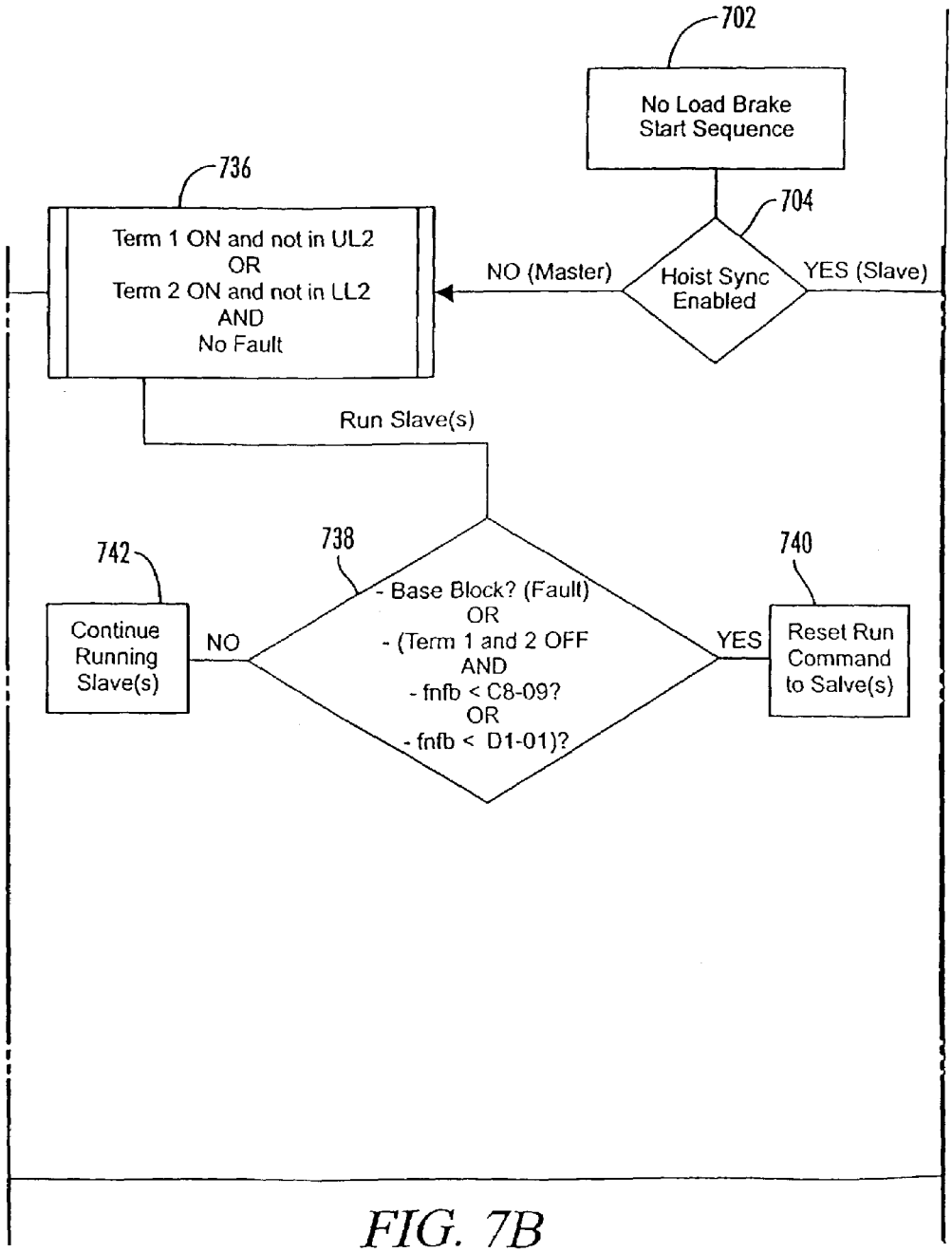
FIG. 7 is a flow chart representation of the hoist synchronization software, collectively represented by FIGS. 7A through 7E.
Figure 7C:
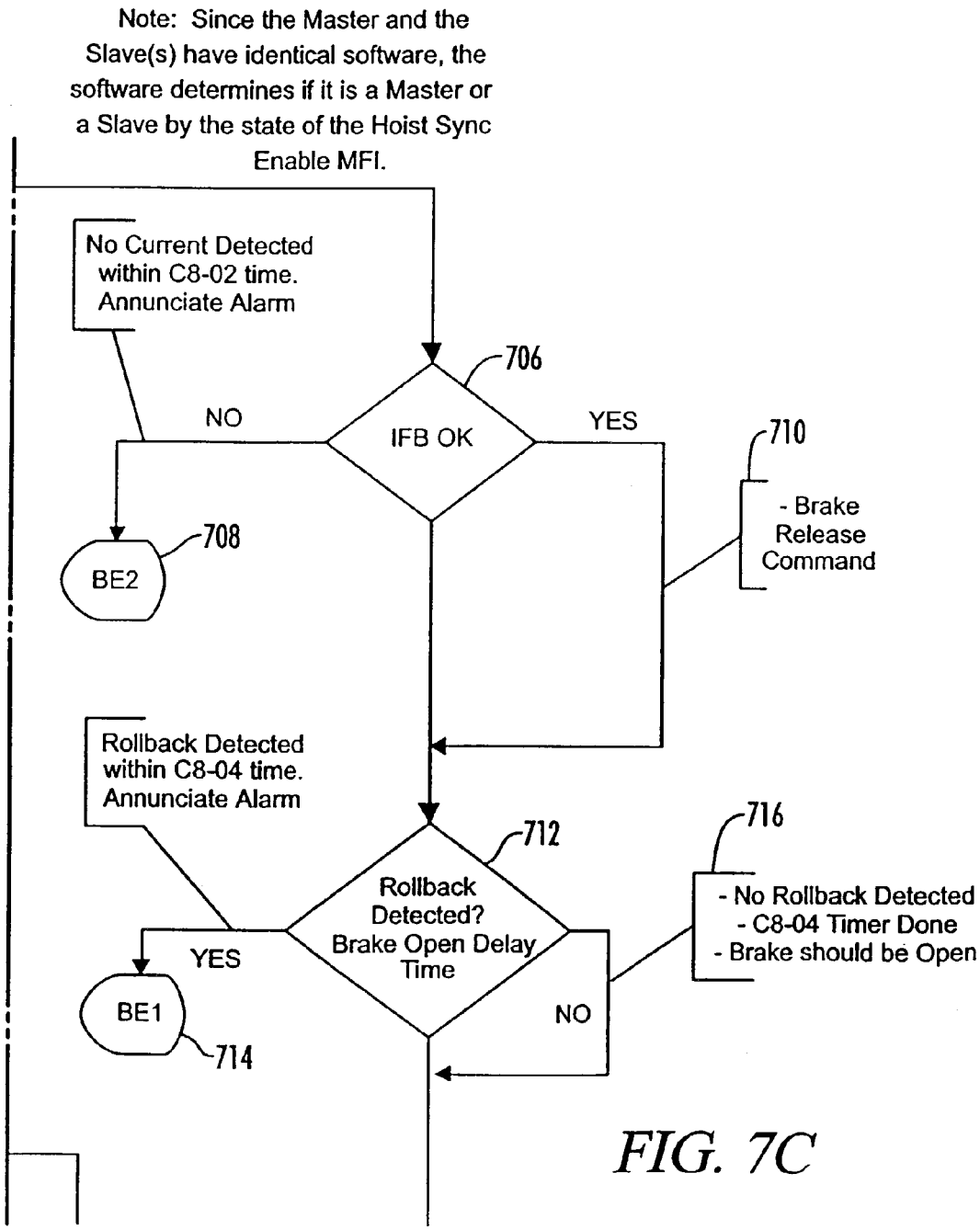
Figure 7D:
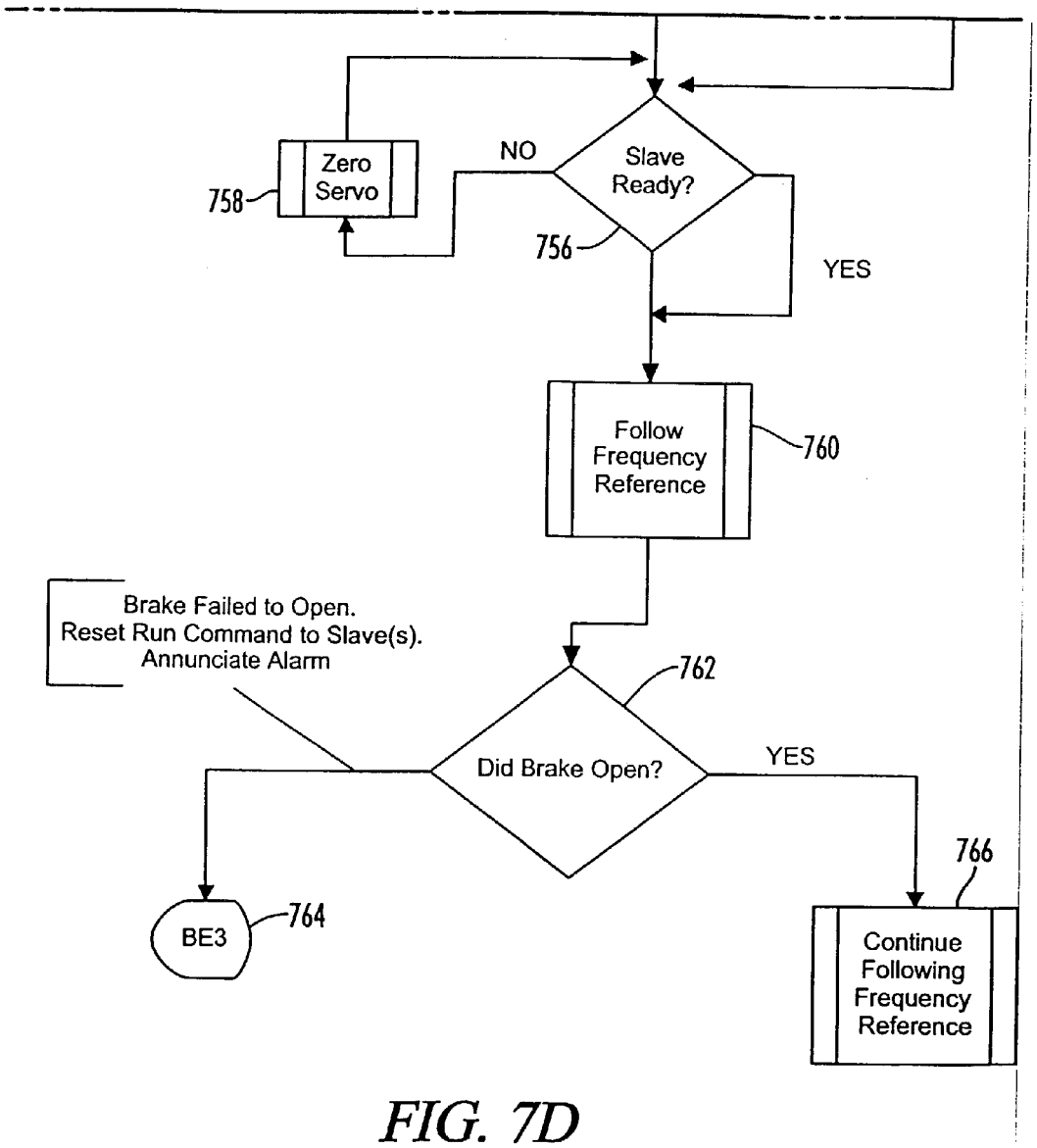
Figure 7E:
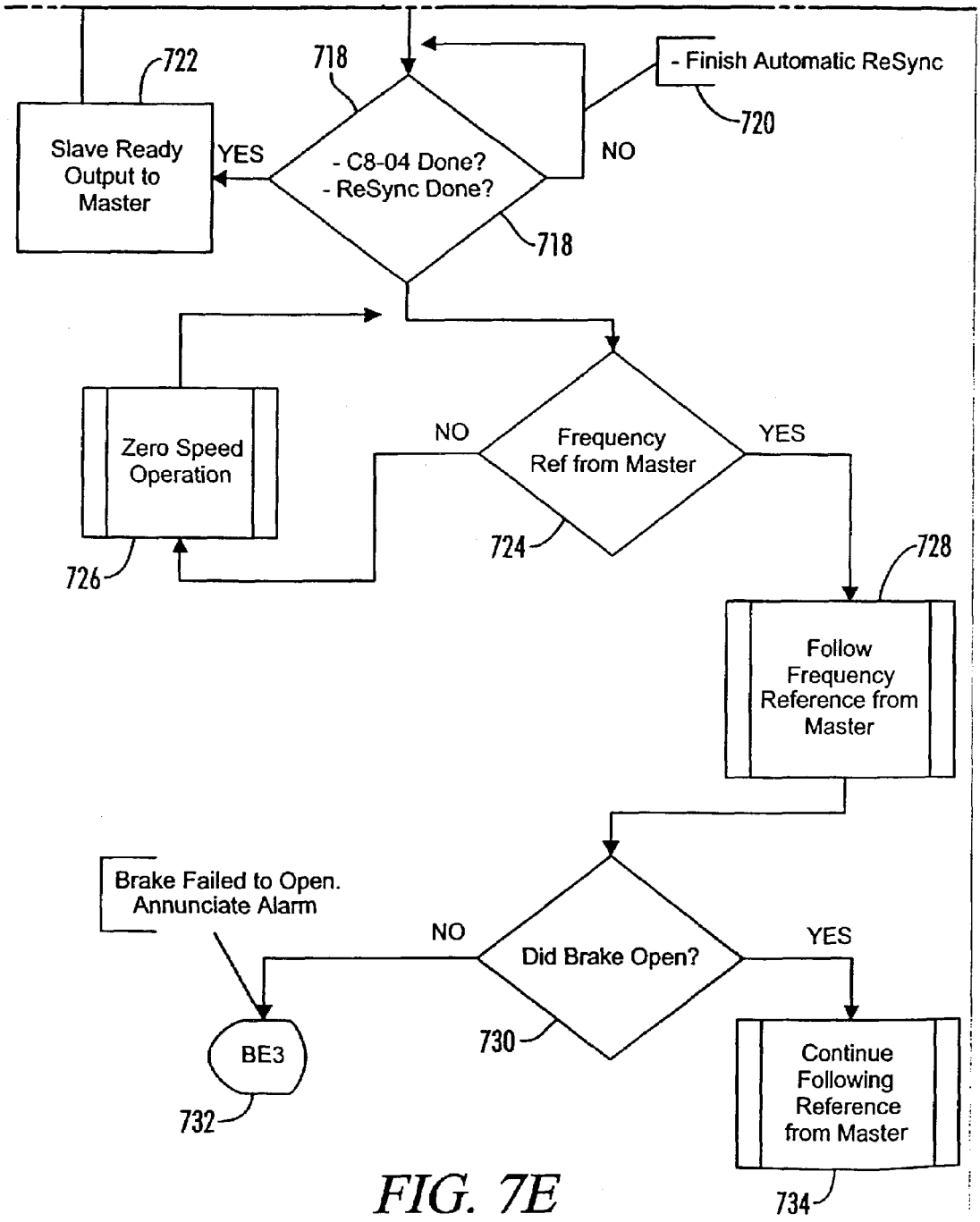

FIG. 6 of the drawings shows the frequency generation portion of the software which is utilized to generate the slave motor signal utilizing information from the master encoder and the slave encoder. Master encoder 108 provides information to the card channel #2 118. Information from the input card 118 is used to calculate the speed from the master encoder 602 to provide an initial slave reference signal 604. The U1 series data outputs provides information for display or other monitoring of the operation of the drives. The slave reference signal 604 information is then utilized to calculate the speed after the appropriate reduction or increase according to the electronic gear ratio 606 to provide a new reference after gear signal 608. This new signal is then adjusted for proportional gain 610 and integral gain 612 to provide the frequency reference for the inverter 616. A transmittal of this reference to the inverter speed regulator 622 passes through the standard drive reference switch 618. The standard driver of the switch 618 is used to toggle between a standard drive reference signal 620 and the frequency reference for the inverter signal 616. This allows for independent operation of the drive with the standard drive reference or synchronous operation through the frequency reference. This switch 618 is controlled by an and gate 634 which has inputs which include queries into the master's operation mode 624, the slave's operation mode 626, the input for the sync mode enable 628 as previously discussed, a terminal reference 630, and a second terminal reference 632. The master operation mode 624 and the slave's operation mode 626 are checks to make sure that the hoists to be synchronized are both moving at a slow speed or stopped before initiating the synchronization feature. This is a safety issue as well as a practical matter since the slave drive would fault if attempting to immediately go from a stopped position to full speed in order to synchronize position with the master drive. The terminal reference 630 is an input indicating that the drive is to move forward (terminal 1) or reverse (terminal 2). When in synchronization mode, the slave drive only uses these inputs as a run command and then follows the master drive. The second terminal reference 632 is an indication that the run command is to come from the terminals as opposed to the keypad or serial communications. Once the frequency reference for the inverter 616 is passed to the inverter speed regulator 622 this is used to control the slave motor operation 104. The slave motor 104 is connected to a slave encoder 110 which passes information through a card channel 118 which provides information to both the inverter speed regulator 622 into a calculator for the number of counts from the slave per scan 678. This calculation 678 is then passed into the position error counter 654. Other inputs for the position error counter come from the card channel 118 which is connected to the master encoder 108. This other card channel 118 provides a signal to calculate the counts from the master with encoder ratios of 636 which sends remainder information to be saved 642 so that the encoder remainder 640 may be utilized in a next calculation of counts 636. The master PPR 638 also provides information both to the calculation of count 636 and the calculation of speed 602. The master PPR 638 is a parameter which indicates the number of pulses per revolution in the master drive's encoder. Used in conjunction with the parameter for the slave drive's encoder pulses per revolution, this determines the ratio between the master and slave drive for their respective encoder pulses per revolution. After the saving of the remainder 642 the input from the master encoder is used to calculate counts from the master with gear ratios 644. Output from the calculation of counts from the master encoder with gear ratios go through a similar process for saving the remainder 652 as a gear remainder 650 which is utilized in the next calculation of counts from the master 644. Other information provided to the calculation of counts from the master gear ratio 644 is provided by a gear ration numerator 646 and a gear ratio denominator 648. The gear ratio numerator 646 and gear ratio denominator 648 also provide information to the calculation of speed after gear ratio 606. Once the calculation of counts from the master of gear ratio 644 has passed through the saving of the remainder 652 the next step is position error counter 654.

The final input for the position error counter 654 comes from the resync select 694 which operates as a switch with 3 positions. The first position is represented as 0 which is clearing position of the error when not running 696. The second position is the accumulation position of error when not running when the position has cleared by the upper limit (UL2) input 698. The final switch position is the accumulate position error when not running position error clear by multi-function input 699.

This information is used by the position error counter 654 which provides information about the synchronization error count 656. This information is passed onto the calculation position error proportional gain 658 which also utilizes the position P gain 662. This information is applied through a + or −2 Hz limit to provide a position P gain 670 which is also added to the calculation speed after gear ratio provided by 606 at point 610. The position error count of 654 is also connected to calculate the position error integral gain 660 which utilizes information from the position I time 664 and provides information to an inquiry of 0 if I time=0 sec 666 which is applied through a + or −2.000 Hz limit 672 for the position I gain 674 which is added to the output of 610 through 612. Output from the position error count of 654 is also provided to the synchronization error compare 680 which utilizes a second input of the synchronization error detection level 682 for the maximum allowed error, a pulse count equal to one motor revolution was used in this example. The synchronization error compare 680 provides an output to the synchronization error select switch 686 which is operated off of the synchronization error select 684. This synchronization error select 686 is connected for three outputs which the first is zero or does nothing 688, the second is synchronization alarms 690 and the third one is synchronization fault 692 to stop operation. This allows for the decision of how to operate the drive when the error exceeds a maximum error level.

FIG. 7 shows the operational flow chart for the software for operation of the new features allowing for resynchronization. The decision tree flow chart starts with a no load brake start sequence 702 which moves on to check if the hoist sync is enabled 704. If the hoist sync is enabled then it means that the hoist is operating as a slave and the IFB is checked to see if it is okay 706. The IFB is an internal drive variable indicating the current reference to the motor. This is a check that sufficient torque exists to hold the load suspended before opening the brake. If the IFB is not okay then no current is detected within the time and an alarm is annunciated 708. If the IFB is okay 706 then the brake release command is issued 710 and then an inquiry is then made as to whether a rollback is detected for the brake open delay time 712. If a rollback is detected at 712 then an alarm is annunciated at 714. If the rollback is not detected then no rollback is detected when the timer is done and the brake should be open 716. The process then moves on to check to see if the resync is done 718 and if not then the finish of the automatic resync 720 is performed. The C8-04 is done and the resync is done 718 then the slave is ready to output to the master 722. After the resync check is done the system waits for a frequency reference from the master 724. If the frequency reference from the master is not detected then the system moves into zero speed operation 726 and waits for the frequency reference from the master 724. If a frequency reference from the master is detected 724 then the frequency reference from the master is followed 728 and an inquiry is made as to whether or not the brake opened 730. If the brake did not open then an alarm is annunciated at 732. If the brake did open then the system will continue to follow the reference from the master 734.

If the hoist sync is not enabled at 704 then the system does not operate as a master. Terminal 1 is on and not in UL2 or terminal 2 is turned on and not in LL2 and a no fault is registered 736. UL2 is a n upper limit alarm. This is an end of travel limit prevents the drive from trying to continue lifting the load once the hook has reached its maximum height. LL2 is a lower limit alarm that operates as a lower end of travel limit. The 3 sets of conditions 736 are checking to ensure that: in an upper limit condition only a down command is acceptable, in a lower limit condition only an up command is acceptable, and if no fault exists then either an up or down command is acceptable. Information is then sent to run the slaves through inquiry 738 which checks for a base block, no run command [terminal 1 and 2 off] and speed feedback below the zero speed level [fnb<C8-09] or speed feedback below the DC inject level [fnb<D1-01] 738. "Base block" refers to a block of the base terminal on the IGBT's, switching transistors used to control the output frequency, which causes an instantaneous change from current output to zero output. Terminal 1 and 2 are the run forward and reverse commands. Fnb is an internal drive variable for the speed feedback. The C8-09 provides a parameter for the zero speed level and D1-01 is the DC inject level. These parameters are check to ensure that the motion is stopped. If this is the case then the reset running command is sent to the slaves 740. If this is not the case then the system continues running the slaves 742. Also after the terminal 1 on 736 the system checks for if the IFB is okay 744 to ensure that sufficient current exists to release the brake. If the IFB is not okay and no current is detected within C8-02 time the reset run command to slaves and the alarm is annunciated at 746. If the IFB is okay then the brake release is sent 748 and an inquiry is made for a rollback detection brake open delay time 750. If a rollback is detected within the time then a reset of run command is sent to the slave and an alarm is annunciated 752. If the rollback is not detected then the timer is done and the brake should be open 754 and an inquiry is made to as to whether the slave is ready 756. If the slave is not ready then a zero servo is operated 758 and an additional inquiry is made for the slave ready inquiry 756. If the slave is ready at 756 then the master will follow the frequency reference provided to it at 760 and inquiry just to make sure that the brake is open 752. If the brake is not open then a reset run command is sent to the slave and an alarm is annunciated 764. If the brake did open at 762 then the master will continue to follow frequency reference provided at 766.

In summary, the benefits of utilizing the hoist software includes the following features and benefits:

Provides automatic resynchronization between two or more hoists.

Accommodates systems having unequal hook speeds.

Compensates for variations in the encoder PPR between two or more hoists.

Enhances safety.

Eliminates the need for a PLC.

Compensates for mechanical differences between two hoist systems.

This new software is designed for applications that require two or more hook pick-ups and in instances where both main and auxiliary hoists are used.

The present invention's compact crane control gives operators total command over crane and hoist movements. The crane and hoist software offers many features designed for ease of use and enhanced safety including easy programming that allows a technician to quickly input the crane's basic operating characteristics. The flux vector control, IMPULSE (trademark) VG+Series 2 used in the preferred embodiment relies on feedback from the motor via an encoder. This closed-loop system allows the control to know what the motor is doing at all times. If the motor changes its operation without input from the crane control, the control can adjust its output. This comparison occurs many times per second to ensure high-precision performance and safe movement of the load.

Thus, although there have been described particular embodiments of the present invention of a new and useful Multiple Hoist Synchronization Apparatus and Method, it is not intended that such references be construed as limitations upon the scope of this invention except as set forth in the following claims.

What is claimed is:

1. A material handling equipment synchronization apparatus for synchronizing positions of a first material handling device and a second material handling device, the first material handling device including a first driven motor connected to a first pulse encoder adapted to generate a first pulse signal, the second material handling device including a second driven motor connected to a second pulse encoder adapted to generate a second pulse signal, the apparatus comprising:

a master inverter adapted to monitor the first pulse signal and control the first driven motor; and a slave inverter adapted to monitor the first pulse signal and the second pulse signal and control the second driven motor, the slave inverter further adapted to derive a position error from the first pulse signal and second pulse signal and adjust the second driven motor to compensate for the position errors.

2. The material handling equipment synchronization apparatus of claim 1 further adapted for synchronizing positions of the first material handling device and a second material handling device by means independent of timing control, wherein, the slave inverter is further adapted to control the second driven slave motor based on the first pulse signal and the second pulse signal wherein the controlling is done independently from a timing control.

3. The apparatus of claim 1, wherein, the slave inverter is adapted to generate an output signal for controlling the second driven motor, and wherein, the slave inverter is further adapted to compensate for the position errors by adjusting the output signal to change the motor position to minimize the position error.

4. The apparatus of claim 1, wherein alignment of the material handling devices is maintained by minimizing position error while both drives are running.

5. The apparatus of claim 1, wherein the slave inverter possesses an automatic resynchronization feature to resynchronize the position of the material handling devices after either of the drives has been operated independently by reducing position error accumulated during the independent operation of the drives.

6. The apparatus of claim 5, wherein selection of the automatic resynchronization feature is controlled by a parameter on the slave drive.

7. The apparatus of claim 1, wherein both material handling devices have an associated position limit, and the position error is cleared when both material handling devices are moved to the position limit.

8. The apparatus of claim 1, wherein the slave inverter further comprises an error clearing input for receiving an error clearing signal, the slave inverter adapted to clear the position error upon receipt of the error clearing signal.

9. The apparatus of claim 1, wherein the slave inverter further comprises an electronic gearing control adapted to operate the second driven motor at a speed ratio of the first driven motor.

10. A hoist synchronization software method for operating a slave controller adapted to control a slave motor attached to a slave encoder in coordination with a master controller adapted to control a master motor attached to a master encoder which provides a pulse reference to the slave controller, the method comprising:

monitoring pulse feedback from both the master encoder and the slave encoder;

calculating a position error from the pulse feedback;

compensating for any position error by adjusting the slave motor output speed.

11. The method of claim 10, wherein the slave controller comprises a microprocessor controlled inverter, and wherein, the master controller follows a master controller trajectory, the method further including the steps of:

receiving the master controller trajectory at the inverter; and wherein the compensation step includes controlling the slave motor to follow the master drive trajectory.

12. The method of claim 10, the method further comprising the steps of:

generating a master encoder signal indicative of the operation of the master motor;

calculating the speed of the master motor from the master encoder signal;

calculating an adjustment ratio;

adjusting the calculated speed in accordance with the adjustment ratio to generate an adjusted calculated speed;

modifying the calculated for proportional gain;

modifying the calculated for integral gain;

selecting from a standard drive reference and frequency reference;

regulating the speed of the slave motor in accordance with the selected signal; and generating a slave encoder signal indicative of the operation of the slave motor.

13. The method of claim 10, further comprising:

storing position error generated when either the master motor or the slave motor is run independently; and correcting for the position error when both the master and the slave motor are commanded to operate at a later time.

* * * * *